United States Patent [19]

Macauley

[11] 3,999,236

[45] Dec. 28, 1976

[54] WATERBED FRAME

[75] Inventor: Christopher Lee Macauley, Pasadena, Calif.

[73] Assignee: Interchange Lighting Corporation, Sun Valley, Calif.

[22] Filed: Feb. 26, 1976

[21] Appl. No.: 661,749

[52] U.S. Cl. ..... 5/370

[51] Int. Cl.[2] ..... A47C 27/08

[58] Field of Search ..... 5/367, 370, 288, 282 R, 5/371, 285; 217/65

[56] References Cited

UNITED STATES PATENTS

| | | | |
|---|---|---|---|
| 129,713 | 7/1972 | Cadwell | 217/65 |
| 406,156 | 7/1889 | Weir | 217/65 |
| 3,736,605 | 6/1973 | Klein | 5/367 |
| 3,838,470 | 10/1974 | May | 5/370 |

*Primary Examiner*—Paul R. Gilliam
*Assistant Examiner*—Andrew M. Calvert
*Attorney, Agent, or Firm*—Ralph B. Pastoriza

[57] ABSTRACT

Side and end boards are assembled to define a rectangular frame for a waterbed. External vertical grooves are formed on the exterior portions of the boards adjacent each of the corners. A metal bracing member comprised of two panels at a right angle to each other with 90° turned in end flanges and a triangular web connecting the top edges of the panels and lying in a plane perpendicular to both panels is positioned above a corner of the frame. The flanges are fitted in the upper ends of the grooves and the bracing member then slid down over the corner so that the panels exteriorally straddle the corner. Each corner of the frame is treated in the same manner to provide an extremely simple assembly operation and resulting strong waterbed frame.

4 Claims, 3 Drawing Figures

WATERBED FRAME

This invention relates generally to waterbeds and more particularly to a method of assembly and components utilized in such assembly to facilitate and improve waterbed frame structures.

BACKGROUND OF THE INVENTION

Waterbeds have become increasingly popular during the last few years. Generally, these beds comprise a watertight mattress filled with water and positioned within a rectangular frame on a suitable supporting surface. The frame itself has an appreciable width in a vertical direction so as to enclose the sides of the mattress.

When a person sits or lies on a waterbed, the water in the watertight mattress is displaced in such a manner that the person's body is neatly cradled by the mattress with substantially equal pressure applied to all contact areas. The displaced water, in turn, will exert substantial forces on the side and end boards making up the rectangular frame surrounding the mattress. In fact, the dynamic forces can greatly increase the normally present static force of water pressure exerted on the interior surfaces of the rectangular frame particularly if violent movements are made on the waterbed.

With the foregoing considerations in mind, it will be appreciated that the rectangular frame encircling the watertight mattress must be of substantial strength to properly confine the waterbed mattress itself to the normally desired overall rectangular shape.

Fairly thick and wide boards may be used in providing the waterbed frame. The problems arise, however, in securing the corners of these boards together to prevent separation under the extreme pressures of the water.

Suitable bracing has been, of course, provided in the past and is presently being used on waterbeds. However, such bracings as are available are generally expensive, very difficult and thus time consuming to install, and in many instances result in protrusions on the interior surface of the frame which could in turn puncture the mattress or exert undue pressure at certain points on the mattress.

One of the main factors in the cost of waterbeds is the labor time involved in assembling the frame and bed portion itself. Normally such assembly is done in the bedroom of a purchaser since the shipment of a mattress filled with water would be impractical. The time for such assembly as well as the integrity of the completed assembly will depend upon the skill of the installers. Both factors increase the cost of the waterbed if the assembly is to be done properly.

BRIEF DESCRIPTION OF THE PRESENT INVENTION

With the foregoing considerations in mind, the present invention has to do with an improved method of assembling waterbed frames and improved components utilized in such assembly, all to the end that the high cost of parts and installation time can be substantially reduced.

More particularly, in accord with the present invention the basic components making up the waterbed frame take the form of side boards of equal length and end boards of equal but shorter lengths, each having their end edges mitered at 45° so that they are in full surface contact with each other when positioned to define a rectangular frame.

In addition, external grooves are formed on the width of the boards on either side of and at equal spacing from the corners of the rectangular frame to provide two grooves adjacent each corner.

A bracing member is provided for each of the four corners and includes two panels at a right angle to each other with 90° turned in end flanges dimensioned to be received in the two adjacent grooves above the grooves of a given corner. The arrangement is such that the bracing member may be simply slid downwardly with the flanges in the grooves and the panels exteriorally straddling the corner of the frame.

The entire frame can thus be assembled extremely quickly without the use of special tools and without introducing any protuberances on the inside surface of the frame.

The metal bracing member itself additionally includes a triangular web on its top lying in a plane mutually perpendicular to the planes of the right angled panel portions which will abut against the top of the corner after the bracing member has been completely slid into position on the corner. This web is important and provides considerable strength to the bracing member.

BRIEF DESCRIPTION OF THE DRAWINGS

A better understanding of this invention will be had by referring to the accompanying drawings in which.

DETAILED DESCRIPTION OF THE PREFERRED EMBODIMENT

Figure 1:
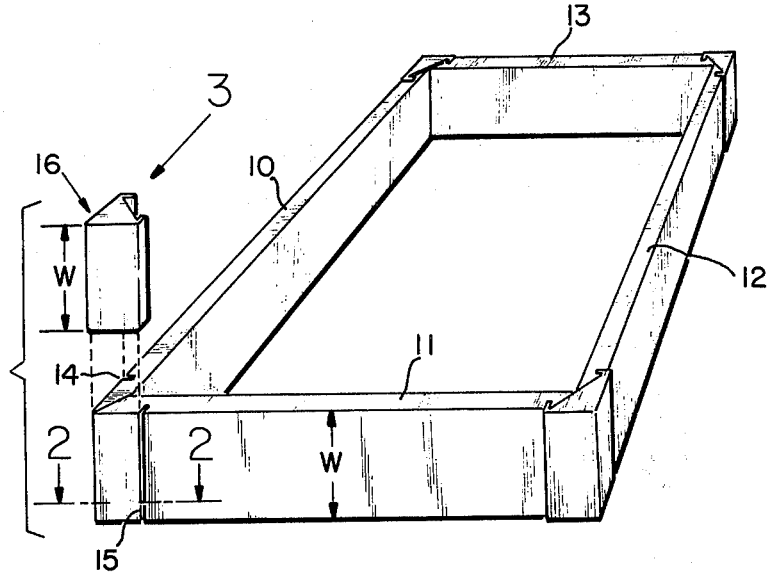
FIG. 1 is a perspective view of the basic components of a rectangular waterbed frame in accord with the present invention illustrating one of the corner bracing members in exploded relationship.

Referring first to FIG. 1, there is shown left, front, right and rear side boards 10, 11, 12 and 13 respectively arranged to define a rectangular frame. As will become clearer as the description proceeds, the end edges of each of the boards is mitered at 45° so that the same will engage in full surface contact when assembled into the rectangular frame shape.

In addition to the foregoing bevelling, the external surface of the adjacent side boards defining the corners are provided with vertical grooves such as indicated at 14 and 15 for the boards 10 and 11.

The rectangular frame shape is secured together at its corners by means of corner bracing members illustrated at the four corners of the frame of FIG. 1, one of these bracing members being shown at 16, exploded above its associated corner.

Figure 2:
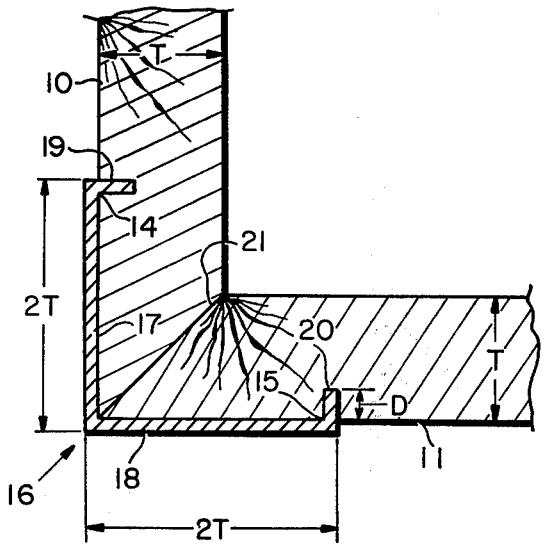
FIG. 2 is an enlarged fragmentary cross section taken in the direction of the arrows 2—2 of FIG. 1; and, FIG. 3 is a perspective view of the exploded corner bracket of FIG. 1 looking in the direction of the arrow 3.

Referring now to the cross section of FIG. 2 which is taken after the corner bracing member 16 has been affixed exteriorally to the corner defined by the boards 10 and 11, the structure includes essentially an integral metal plate centrally folded at a right angle to define side panels 17 and 18 arranged to straddle the exterior corner of the frame. Each side panel terminates in an end flange as indicated at 19 for the panel 17 and 20 for the panel 18 turned inwardly for reception in the vertical grooves 14 and 15 respectively.

The extent of the end flanges 19 and 20 is preferably less than the thickness T of the side boards making up the frame, the depth of the receiving slots corresponding in distance to these flanges as indicated by the letter D in FIG. 2.

In the preferred embodiment, the extent of the side panels 17 and 18 from the fold or line of bending along the exterior adjacent surfaces of the boards 10 and 11 is equal to twice the thickness T. Because of the 45° mitering of the end edges of the boards as indicated at 21 in FIG. 2, the exterior surface engagement by the panels 17 and 18 is equal for each of the boards 10 and 11. In this respect, the vertical height of the bracing member 16 as shown in FIG. 1 and depicted at W corresponds to the vertical width of the various boards making up the frame so that the entire exterior corner is covered by the bracing member.

Figure 3:
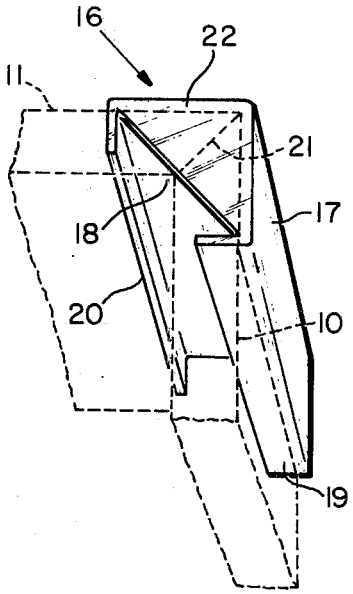

Referring to FIG. 3 which illustrates in perspective the bracing member 16 viewed from the direction of the arrow 3 of FIG. 1, it will be noted that the bracing structure additionally includes a triangular web 22 connecting the top edges of the panels 17 and 18. As a consequence of the dimensioning for the panels as described, the triangular web 22 is a right isosceles triangle, the base of which extends from the end of one panel to the end of the other and thus will have a length equal to twice the thickness of the board times 1.414.

The triangular web 22 provides considerable strength to the panels 17 and 18 cooperating with the slots and turned in end flanges 19 and 20 in preventing spreading or possible popping out of the corner bracing member under high pressures exerted internally on the corner boards.

ASSEMBLY OPERATION

In accord with the method of assembling the waterbed frame in this invention, the various boards making up the basic frame structure are provided initially with 45° mitered ends as described and with the vertical grooves as described. Also, four bracing members corresponding to 16 are provided, all of identical shape.

When an installer arrives at a home where the bed is to be assembled, it is a very simple matter to position the various boards to form the rectangular array shown in FIG. 1 and thereafter position the bracing member such as the bracing member 16 above a corner and fit the flanges into the grooves and then urge the bracing member downwardly until the triangular web 22 engages the top of the corner.

The foregoing process is simply repeated for the remaining three corners with the remaining three braces.

It will be immediately appreciated that the frame assembly portion of the installation of the bed can be carried out extremely rapidly and with a minimum of tools or skill necessary. Moreover, the corner bracing structures provide substantial strength against inward hydro-dynamic pressures exerted on the frame.

From the foregoing description, it will thus be evident that the present invention has provided a greatly improved waterbed frame as well as an improved method of assembly of the same.

What is claimed is:

1. A method of assembling a waterbed frame made up of equal length side boards and end boards of equal but shorter lengths, comprising the steps of:

a. mitering the end edges of the boards at 45° so that the mitered edges are in full surface contact when the boards are positioned to define a rectangular frame;

b. forming external vertical grooves down the width of the boards on either side of and at equal spacing from the corners of the rectangular frame to depth less than one half the thickness of the boards to provide two grooves adjacent each corner;

c. positioning a metal bracing member made up of two panels at a right angle to each other with 90° turned in end flanges dimensioned to be received in two adjacent grooves and a triangular web connecting the top edges of the panels, above the grooves of a given corner;

d. sliding said bracing member downwardly so that said panels exteriorally straddle the corner of the frame with the flanges fitted in the grooves until the triangular web engages the top of the corner; and, e. repeating the last mentioned step with additional bracing members for the remaining three corners of the frame.

2. A waterbed frame including, in combination:

a. left, front, right and rear side boards arranged to define a rectangular frame; and b. an external bracing member at each of the four corners of the rectangular frame, each bracing member including an integral metal plate centrally folded at a right angle to define side panels arranged to straddle the exterior corner of the frame, each side panel terminating in an end flange bent inwardly, the adjacent side boards defining the corner having vertical grooves cut therein for receiving said flanges, said bracing member further including a web plate in the shape of a 90° isosceles triangle connecting the top edges of the side panels and arranged to overlie the top of the corner defined by the side boards when said bracing member is in position on said corner.

3. A waterbed frame according to claim 2, in which each end flange extends normally from the inner face of its associated side panel to a distance less than one half the thickness of the side board, the groove in the boards having a corresponding depth, each side panel of the bracing member extending from the fold line a distance equal to twice the thickness of the side board and having a vertical dimension equal to the width of the side board, said web plate having a base length equal to 1.414 times twice the thickness of the side board.

4. A waterbed frame according to claim 3, in which the end edges of the side boards meeting to define the corners of the rectangular frame are mitered at 45° so that equal areas of the exterior surface portions of the side boards are engaged by the side walls of the bracing member.

* * * * *